United States Patent [19]

Kozyrski et al.

[11] Patent Number: 5,076,482

[45] Date of Patent: Dec. 31, 1991

[54] PNEUMATIC POINT DRIVER

[75] Inventors: Vincent T. Kozyrski, Plainville; Alan R. Peters, Monroe, both of Conn.

[73] Assignee: The Fletcher Terry Company, Farmington, Conn.

[21] Appl. No.: 594,718

[22] Filed: Oct. 5, 1990

[51] Int. Cl.[5] ..... B25C 5/13; F01L 9/02

[52] U.S. Cl. ..... 227/130; 91/461; 173/169; 251/33

[58] Field of Search ..... 227/130, 107, 8; 91/461; 251/33; 173/169

[56] References Cited

U.S. PATENT DOCUMENTS

| | | | |
|---|---|---|---|
| 2,886,815 | 5/1959 | Young | 1/44.4 |
| 3,313,213 | 4/1967 | Wandel | 91/461 |
| 3,323,602 | 6/1967 | Lysell | 173/169 |
| 3,720,364 | 3/1973 | Maestri | 227/109 |
| 3,809,307 | 5/1974 | Wandel et al. | 227/8 |
| 4,699,307 | 10/1987 | Kozyrski et al. | 227/132 |

OTHER PUBLICATIONS

Air, Inc. product catalog entitled "Fluid Power Components and Controls"—p. V-193, publication date unknown.

*Primary Examiner*—Hien H. Phan
*Assistant Examiner*—Raymond D. Woods
*Attorney, Agent, or Firm*—Ira S. Dorman

[57] ABSTRACT

A pneumatically powered point driver utilizes a valve mechanism having a core that is operated by air conducted therethrough from the supply source. The valve core is preferably provided with an enlarged head, to enhance the rapidity and firmness of the action produced.

19 Claims, 3 Drawing Sheets

PNEUMATIC POINT DRIVER

BACKGROUND OF THE INVENTION

Apparatus for driving points, of the kind used by framers and glaziers, is well known in the art. A particularly desirable form of point driver is described and claimed in Kozyrski et al U.S. Pat. No. 4,699,307, issued Oct. 13, 1987.

It has in the past been recognized to be advantageous to power, by electrical or pneumatic means, machines of a nature broadly similar to point drivers. For example, Young U.S. Pat. No. 2,886,815, issued May 19, 1959, provides a clip application gun that includes pneumatic driving means for the staples utilized; and Maestri U.S. Pat. No. 3,720,364, issued Mar. 13, 1973, provides a tool for driving and setting headless nails and tacks, which may be operated mechanically or pneumatically.

In any such machine so powered, it is of course important that the action imparted by the pneumatic system be rapid and reliable. As far as is known, there has not heretofore been provided a pneumatically powered driver for framers' and glaziers' points which is entirely satisfactory from these, and other, standpoints.

Accordingly, it is the broad object of the present invention to provide a novel driver for framers' and glaziers' points, which is pneumatically powered and which affords highly reliable, rapid action for repetitively ejecting and driving such points.

A more specific object of the invention is to provide such a driver having incorporated therein a novel valve mechanism which is fundamental to the achievement of optimal operation.

Another object is to provide a novel valve mechanism that is suitable for use in a pneumatically powered point driver, for imparting thereto a highly reliable and rapid drive capability.

Additional objects of the invention are to provide such a point driver and valve mechanism affording the foregoing features and advantages, which are in addition relatively uncomplicated and inexpensive to manufacture, and highly efficient and convenient in use.

SUMMARY OF THE INVENTION

It has now been found that certain of the foregoing and related objects of the invention are attained by the provision of a machine for driving framer's and glazier's points, comprising a body, a hammer assembly supported by the body for reciprocal movement, fastener support means, pneumatic means, and an actuating member. The hammer member includes a push member which has a contact element that is movable along a path between first and second positions, during reciprocation of the hammer assembly, for driving contact with a fastener, so disposed by the support means as to intercept and contact the push member. The pneumatic means drives the hammer assembly; it comprises a piston cylinder providing a chamber, a drive piston reciprocally mounted in the cylinder chamber, and a valve mechanism operatively connected to the cylinder for controlling the entry and exit of air, thereby to effect reciprocation of the piston and, in turn, operation of the hammer assembly.

The valve mechanism includes housing means having an inside wall surface defining an axial passageway, and a valve core member slidably disposed for axial movement within the passageway. Two axially spaced sealing elements are provided on the core member, and two valve seats are provided by internal structure of the housing means. One of the sealing elements engages one of the valve seats in a first position of the core member, and the other sealing element engages the other valve seat in a second position thereof. The core member is configured to permit the flow of air from an outlet opening of the housing means in its "first" position, and to permit the flow of air between an inlet opening and the outlet opening in its "second" position. It also has a head portion which is disposed within the passageway in sealing, slidable engagement with the inside wall surface of the housing means.

Formed within the core member is a duct, which has one end opening in air-flow communication with the inlet of the housing means, and an opposite end opening on the outer surface of the head portion. A wall element overlies the adjacent end of the passageway of the housing means, and defines a head space over the core member. It has an opening, which is closed by a closing element on the actuating member in a first position thereof, the closing element being displaced in a second position of the actuating member to thereby permit the release of air. Air pressure counteracts biasing means that acts upon the core member, so as to force it away from the end wall element when the opening is closed, and release of the air permits the biasing means to thrust the core member in the opposite direction. Normally, the actuating member will be in the form of a trigger pivotably mounted on the machine body, and the piston cylinder will be provided by a housing disposed against the valve housing means.

The core member of the valve mechanism will preferably comprise a generally cylindrical pilot piece and an elongate spool piece. The pilot piece will have an axial bore, and the spool piece will have a tang component at one end inserted into the bore to join the pieces together and to cooperatively define at least a portion of the core member duct. Most desirably, the head portion of the core member will be of enlarged trans-axial cross section, as will be the corresponding axial portion of the passageway in which it is seated. In some instances, it will be desirable for the housing means to comprise two components, namely a housing member and a valve body, the latter being seated in an elongate cavity of the housing member, and having a bore in which the core member is seated, with internal structure of the valve body providing the valve seats.

A support wall at the bottom of the machine body, on which it will rest in normal use, may have an engagement opening to cooperate with a detent component on a slidably mounted member of the hammer assembly, engagement of the detent serving to prevent movement of the hammer assembly from its retracted position. The detent component will have a protruding portion, so constructed that when its outermost surface is brought to a level flush with the outer surface of the support wall the engagement element of the detent component will disengage from the opening-defining structure; this will release the assembly for movement toward its extended position.

Other objects of the invention are attained by the provision of a valve mechanism, having the features herein described.

DETAILED DESCRIPTION OF THE ILLUSTRATED EMBODIMENTS

Figure 1:
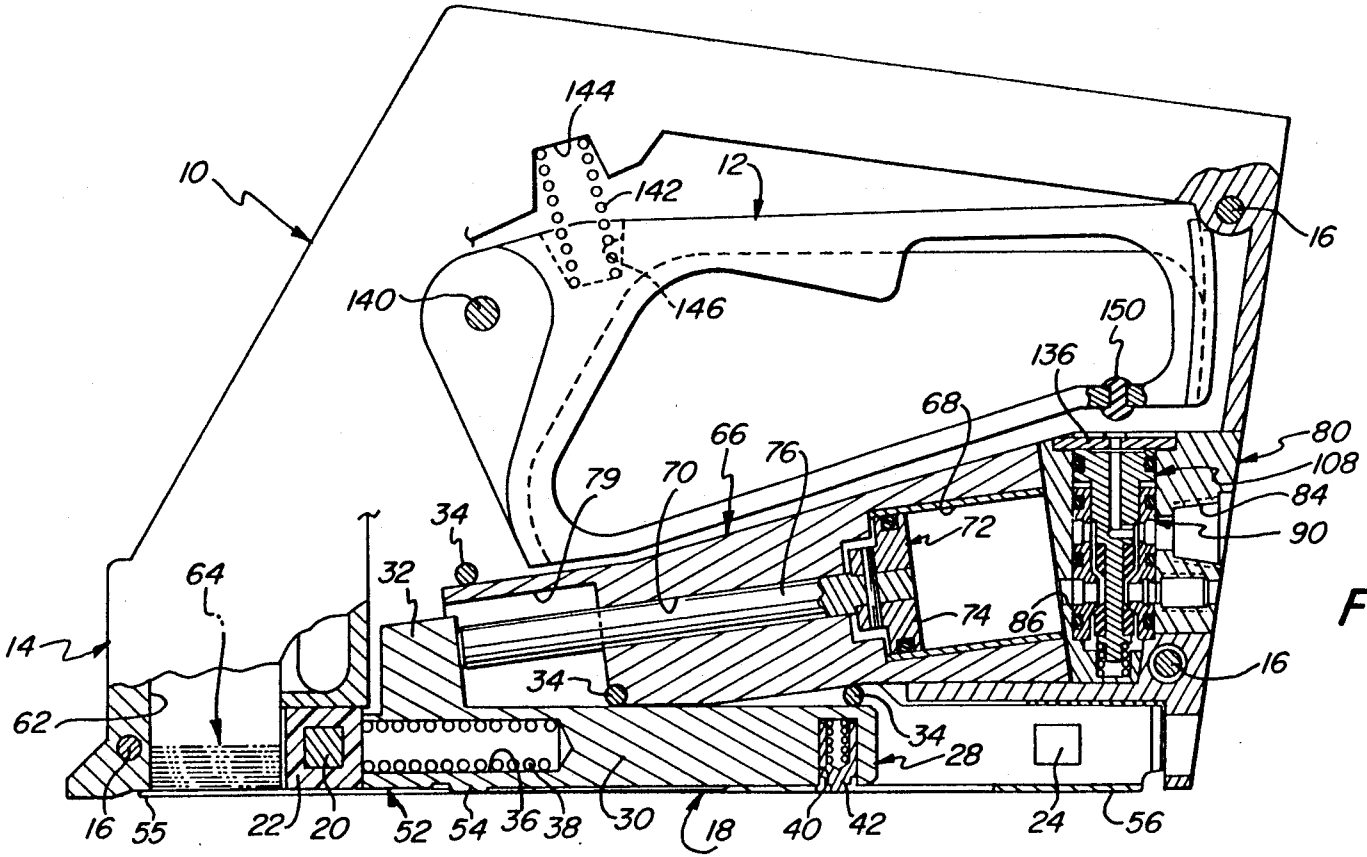
FIG. 1 is a side elevational view, in partial section, showing a point driving machine embodying the present invention.
Figure 2:
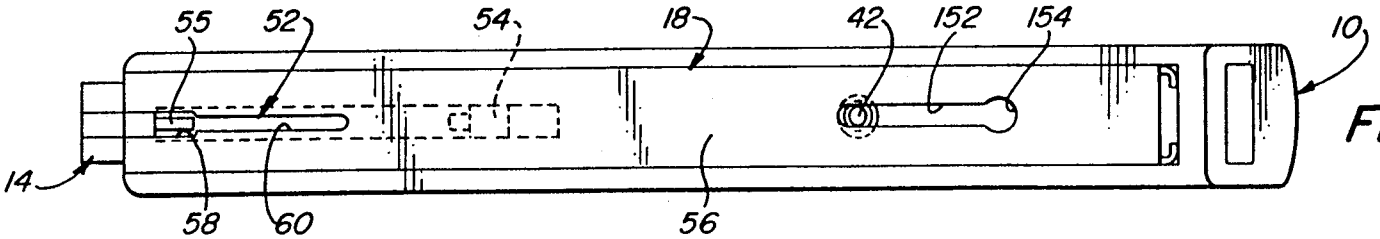
FIG. 2 is a bottom view of the machine of FIG. 1.
Figure 3:
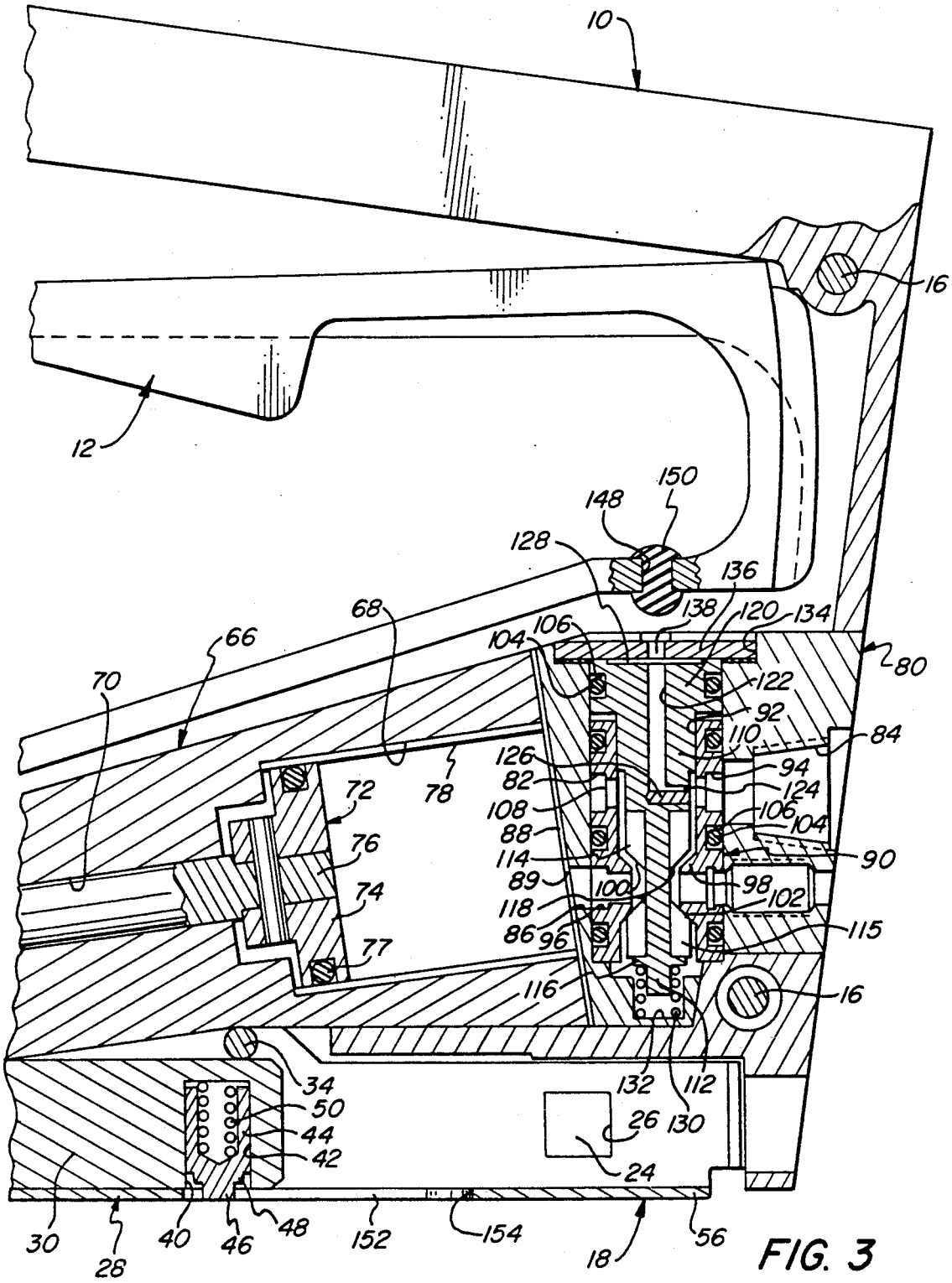
FIG. 3 is a fragmentary elevational view of the rearward section of the machine, as shown in FIG. 1 but drawn to a scale enlarged therefrom.

Turning initially to FIGS. 1-3 of the drawings, therein illustrated is a machine embodying the present invention and consisting of a frame-like handle, generally designated by the numeral 10, a trigger generally designed by the numeral 12 pivotably mounted upon the handle, and magazine structure, generally designated by the numeral 14, disposed at the forward end thereof. The handle consists of two mirror-image sections, secured to one another by screws 16. A U-shaped, elongated metal channel, generally designated by the numeral 18, is mounted between the handle sections at the bottom of the machine, and is held in place partially by a transverse stop bar 20. The stop bar 20 is in turn secured between the handle halves by screws (not seen), and it carries a transverse bumper 22 made of a tough and durable resilient material, such as polyurethane. The other end of the channel 18 is secured by opposing bosses 24 (only one of which is visible) which project from the inside surfaces of the handle sections into the square openings 26.

A hammer assembly, generally designated by the numeral 28, is slidably mounted within the U-shaped channel 18; it consists of an elongated body portion 30 of square cross section, and an upstanding lug element 32 integrally formed with the body portion adjacent its forward end. Guide pins 34 traverse the handle sections and the metal channel 18 (the lateral walls of which are widened to accommodate the pins), two of which serve to constrain the handle assembly to reciprocal movement and to prevent its upward displacement out of the channel. A blind axial bore 36 extends inwardly from the forward end of the body portion 30, and seats a coil spring 38; the outer end of the spring bears upon the bumper 22, and thereby urges the hammer assembly in a rearward direction. Socket 40, which extends upwardly from the lower surface of the body portion 30 at a location adjacent its rearward end, slidably seats a cylindrical pin 42, which is formed with an axial bore 44 and concentric circular step elements 46 and 48; a coil spring 50 is seated in the bore 44, and serves to urge the pin 42 outwardly of the socket 40.

The body portion 30 of the hammer assembly carries an elongated, strip-like push plate, generally designated by the numeral 52, which is attached against the lower surface of the body portion and projects forwardly therebeyond. The rearward edge of the push plate 52 abuts against a protuberance 54 formed on the body portion 30, and it has associated means (not visible) by which it is affixed in place. A downwardly protruding, longitudinal rib element 55 extends to the leading edge of the forward end portion of the push plate 52, and the bottom wall 56 of the channel 18 is formed to accommodate the plate. In particular, the forward end of the bottom wall 56 has an outer slot section 58 therethrough, and a narrower, inner section 60, which is dimensioned and configured to slidably receive the rib element 55.

The magazine structure 14 defines a channel or passageway 62 for the containment of a stack of points, generally designated by the numeral 64, disposed in the path of movement of the push plate 52. A longitudinal gap (not shown) extends along the inner-most portion of the magazine structure, to permit entry of the nose portion of a follower piece (also not shown) into the channel 62; the follower piece is mounted upon the handle 10, and is spring loaded to bear upon the top of the stack 64 of points and thereby urge them toward the push plate travel path.

A cylinder housing, generally designated by the numeral 66, is mounted within the lower portion of the handle 10 adjacent the hammer assembly 28, constrained by the guide pins 34. The housing is elongated and defines at its rearward end a chamber 68 of cylindrical cross section, from which extends forwardly a bore 70 opening to a recess 79 at the forward end of the housing 66, the recess 79 being dimensioned and configured to receive the lug portion 32 on the hammer assembly 28.

The chamber 68 and bore 70 cooperate to receive an operating piston, generally designated by the numeral 72. The head 74 of the piston is disposed within the chamber 68, and the rod 76 thereof is disposed within the bore 70. An O-ring 77 is seated in a channel (unnumbered) extending circumferentially about the head 74, and provides a sliding seal against the surface of the cylindrical metal wall liner 78 seated within the chamber 68.

A valve assembly housing, generally designed by the numeral 80, is mounted into the rear of the handle 10, directly adjacent the cylinder housing 66. The valve housing 80 has a passage 82 formed downwardly into it, and it has an inlet opening 84 and an outlet opening 86 at spaced locations along the passage 82 and disposed to opposite (rearward and forward, respectively) sides thereof; the inlet opening 84 is provided with means (not illustrated) for engaging a pneumatic hose connector. A gasket 88 is interposed between the end surface of the cylinder housing 66 and the adjacent lateral surface of the valve assembly housing 80, and is provided with a hole 89 to permit air flow between the valve assembly housing 80 and the cylinder chamber 68.

A valve body, generally designated by the numeral 90, is disposed within the passage 82 of the valve housing 80. It has a downwardly extending axial bore 92, with inlet and outlet orifices 94, 96, aligned respectively with the inlet and outlet openings 84, 86 of the housing 80; the lower end of the bore 92 is vented simply by being open to the atmosphere. Internal shoulder structure 98 of the body 90 defines oppositely directed, frustoconical valve seat surfaces 100 and 102 within the bore 92, and O-rings 104, seated within circumferential grooves 106, sealingly engage the valve body 90 within the passage 82.

A valve core, generally designated by the numeral 108, is slidably seated within the bore 92 of the valve body 90. It includes a pilot portion 110, and spool and head portions 112, 120, respectively, disposed to the opposite ends thereof. The spool portion 112 carries a pair of sealing elements 114, 115, which are generally cylindrical but have confronting ends that are tapered so as to conform to, and form a tight seal against, the valve seat surfaces 100, 102. The sealing elements 114, 115 are held in place between the lower end surface of the pilot portion 110 and the axially spaced collar element 116, which cooperate with the two intermediately positioned circumferential shoulder elements 118.

The head portion 120 of the valve core is disposed outwardly of the valve body 90, within the section of the passage 82 of the housing 80 lying therebeyond; both the head portion and also the corresponding passage section are of enlarged trans-axial cross section, relative to the remaining portions and section thereof (including, as to the latter, the bore 92), respectively. A duct 122 extends axially through the pilot portion 110 and head portion 120. One end of the duct 122 opens onto the shallow depression 128 formed into the top surface of the head portion 120, and the opposite end joins a laterally extending pore 124, the latter being created by inserting a partial plug 126 into a radially extending hole (unnumbered) formed near the lower end of the pilot portion 110.

The valve assembly housing 80 defines a socket portion 132 at the bottom of the passage 82, in which is seated a coil spring 130. The spring bears upon the collar element 116 of the spool portion 112, urging upwardly the valve core 108. The housing 80 also defines a shallow annular recess 134 about the mouth of the passage 82, in which is affixed an end wall element 136, which spans the passage and forms a small chamber with the depression 128 when the valve core is in its fully elevated position. An aperture 138 extends through the wall element 136 to provide free air flow communication with the chamber so defined.

The trigger 12 is pivotably mounted on the handle 10 by a transverse pin 140; it is biased downwardly by a coil spring 142, which has its opposite ends seated in confronting recesses 144 and 146 formed, respectively, into the handle 10 and the trigger 12. A rubber sealing plug 150 is engaged in a hole 148 formed through the lower leg of the trigger 12, in registry with the aperture 138 through the end wall element 136 of the valve assembly. As will be appreciated, in its lowered position (not illustrated) the trigger 12 will cause the plug 150 to bear upon the top surface of the wall element 136, thereby sealing the aperture 138 to prevent air flow therethrough.

In operation, air will flow from the pressurized supply provided, through the inlet opening 84 of the handle 10 and the aligned orifice 94 of the valve body 90, passing into the pore 124 defined within the (unnumbered) hole and thereafter upwardly through the duct 122 and into the shallow chamber defined between the wall element 136 and the piston head portion 120. With the trigger 12 in its lowered position (just referred to), the pressure of accumulated air will bias the valve core 108 downwardly (from the position illustrated) against the force of the coil spring 130. This will cause the upper sealing element 114 to bear upon the valve seat surface 102, thus preventing the flow of air past that point while permitting flow from the cylinder chamber 68 past the lower element 115, for venting to the atmosphere. Under such conditions, the drive piston 72 will be brought to its retracted position (i.e., shifted to the right from that shown in FIG. 1), due to the force of the spring 38 in the hammer assembly 28, transmitted through the lug element 32 thereof.

Squeezing of the trigger 12 will of course elevate the plug 150 away from the wall element 136, thereby permitting air to discharge through the aperture 138. The release of the restraining force will permit the spring 130 to thrust the valve core 108 abruptly upwardly, thereby bringing it to the position shown in FIGS. 1 and 3, in which the upper sealing element 114 is displaced from the seating surface 102 and the lower sealing element 115 is engaged upon the surface 100. In this position air will flow through the orifice 94, downwardly about the reduced diameter section of the pilot portion 110, past the valve seat surface 102, through the orifice 96, the outlet opening 86, and the gasket hole 89, and finally into the drive piston chamber 68. The pressure of air will of course force the piston 72 forwardly, in turn driving the hammer assembly 28 in the same direction to thereby cause the push plate 52 to contact and eject the lower-most point in the stack 64.

Upon release of the trigger 12, and consequential closure of the aperture 138, the air pressure developed will again move the valve core 108 downwardly, simultaneously terminating flow into the piston chamber 68 and permitting the drive piston 72 to resume its retracted position.

It will be appreciated that the enlargement of head portion 120 increases the surface area of its top face, thereby maximizing the effectiveness of the air confined thereabove in driving the core 108 downwardly and in holding the sealing element 114 securely against the surface 102. Were it otherwise, leakage of air past the sealing element would tend to assist the spring 130 in elevating the valve piston, causing the core to tend to "float" and thus compromising the effectiveness, reliability and rapidity of operation of the machine. It will also be appreciated that the aperture 138 is sized so as to permit virtually immediate discharge of air when the plug 150 is displaced, and that the dimensions of the duct 122 and pore 124 are selected to afford optimal operation, contributing further to the effectiveness of the driving action.

Although not shown in the illustration, it will be understood that, when the hammer assembly 28 is in its rearward position, the outward force of the internal coil spring 50 will cause the larger, inner step element 48 of the pin 42 to engage within the circular portion 154 of the elongate keyhole slot 152, which is formed through the bottom wall 56 of the channel 18. This will serve to maintain the hammer assembly in its retracted condition, effectively rendering the driver inoperative despite actuation of the trigger 12. When however inward force is brought to bear upon the outer end of the pin 42, such as by placing the machine on a flat surface (as is invariably done in proper use), the element 48 will be displaced from the circular slot portion 154; this will present thereto the smaller outer step element 46, which is dimensioned to slide along the rectilinear slot portion and will thus render the driver operative. Needless to say, operation of the trigger with the machine in an unsupported position would expose the user, and others in the vicinity, to considerable risk of injury from ejected points.

Figure 4:
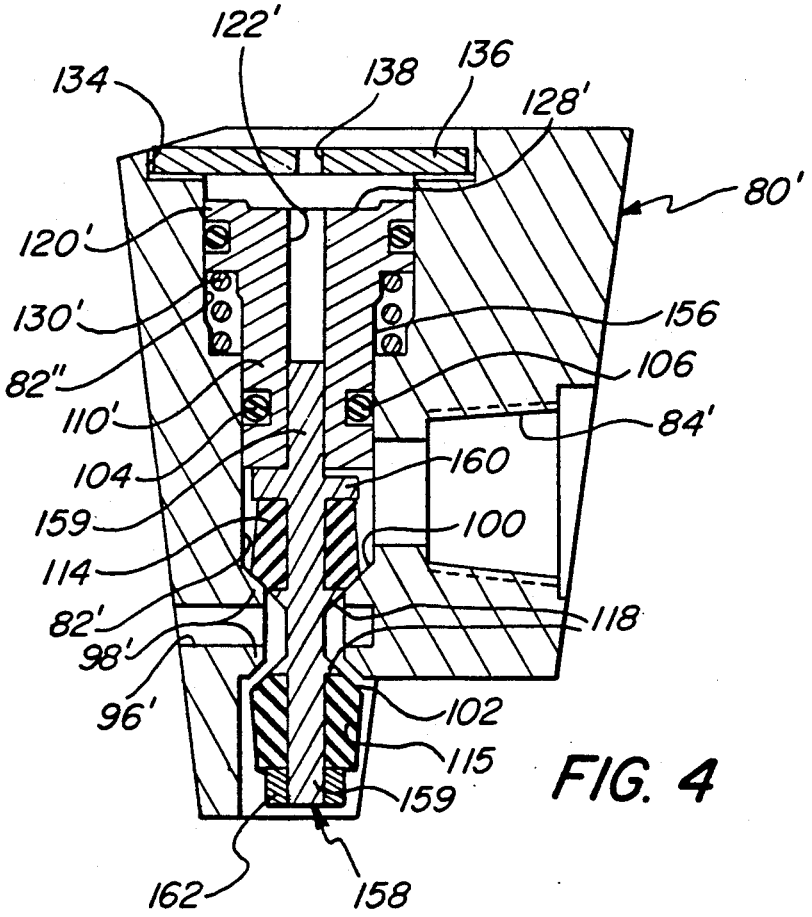
FIG. 4 is a sectional view showing a second form of valve mechanisms embodying the present invention.

Turning now to FIG. 4 of the drawings, therein illustrated is a second form of valve mechanism embodying the present invention. To the extent that it (and also the mechanism of FIG. 5, to be discussed hereinafter) has components and elements comparable to those of the driver shown in FIGS. 1 and 3, common numbers (albeit primed in some instances) are employed.

The valve housing 80' has a compound passage extending therethrough, consisting of a lower, relatively small diameter section 82' and a larger diamter upper section 82". The inlet opening 84' leads directly to the passage section 82', and the outlet opening 96' leads directly from it at a location intermediate the valve seat surfaces 100, 102, the latter being provided by the internal shoulder structure 98'. It will be noted that in this embodiment the assembly includes no separate valve body, and that the structure 98' is provided by the housing 80' itself.

The valve core consist of two pieces, a pilot piece generally designated by the numeral 156, and a spool piece generally designated by the numeral 158. The pilot piece 156 consists of a pilot portion 110' and a head portion 120', through which extends axially a duct 122', opening at its upper end to the shallow depression 128' formed into the top surface. The pilot piece carries two sealing rings 104, seated in suitably located circumferential channels 106.

The spool piece 158 includes a shaft portion 159, on which are provided an upper abutment element, in the form of a circumferential collar element 160 and a pair of intermediate retaining elements 118. The upper sealing element 114 is held between the element 160 and the upper retaining element 118, and the lower sealing element 115 is held between the lower element 118 and a washer 162, which is press-fit upon the bottom end of the shaft portion 159. The spool piece 158 is itself assembled with the pilot piece 156 by press-fitting the upper end of its shaft portion 159 into the lower end of the duct 122'. As will be noted, the upper collar element 160 is formed so as to define a gap along the lower end of the head piece 156; and although not visible, a longitudinal pore section extends along the length of the upper portion 159 of the shaft, thus providing air flow communication to the duct 122'.

A coil spring 130' is disposed in the passage section 82" with its lower end bearing upon the shoulder formed at the intersection with the section 82', and with its upper end bearing upon the underside of the head portion 120'; the spring 130' thus serves to urge the core assembly in an upward direction (i.e., displaced from the position illustrated in FIG. 4). Here again, an end wall element 136, having a central aperture 138, is seated in the recess 134 and overlies the mouth of the passage section 82" to form a head space with the depression 128'. The valve mechanism of FIG. 4 works in the same way as that previously described, with air passing into the duct 122' from the inlet opening 84' to force the core assembly downwardly. The sealing plug 150 on the trigger 12 also functions in the same manner to selectively permit or prevent the passage of air through the aperture 138.

Figure 5:
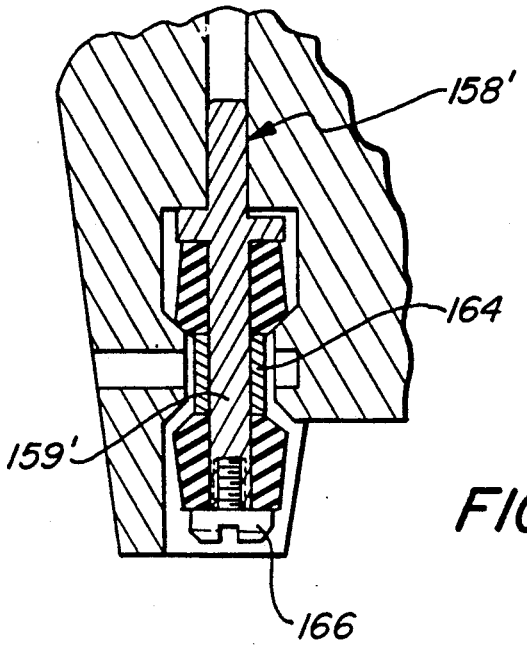
FIG. 5 is a fragmentary view similar to that of FIG. 4 and showing another form of valve mechanism embodying the invention.

Turning finally to FIG. 5 of the drawings, the valve mechanism shown is similar to that of FIG. 4 but utilizes a somewhat different form of the spool piece, generally designated by the numeral 158'. Instead of providing retaining elements 118, the spool piece in this embodiment employs a collar 164, which is press-fit onto the shaft portion 159'. Also, in place of the washer 162 the assembly of FIG. 5 utilizes a screw 166, which is engaged in the end of the shaft portion 159' to hold the lower sealing element 115 in place.

The driver of the invention, and the components of which it and the valve mechanism are comprised, may be largely of plastic construction, but metals will be used where appropriate, as will be self-evident and as has been mentioned hereinabove with respect to the cylinder liner 78. It should be appreciated that, with the exception of the valve mechanism and the associated operating and pneumatic features, the driver itself may be of conventional design; it may most desirably take the form described in the above-identified Kozyrski et al patent (modified as appropriate), the specification of which is therefore hereby incorporated by reference. Indeed, it should be understood that the valve mechanism itself has wide applicability, and can be used for machines and systems of a nature completely different from the point driver herein described, albeit that the combination therewith represents a unique and highly desirable embodiment of the invention. Many modifications can of course be made to the valve mechanism and the machine as herein described and illustrated, without departure from the novel concepts underlying the invention.

Thus, it can be seen that the present invention provides a novel driver, for framers' and glaziers' points, which is pneumatically powered and which affords highly reliable, rapid action for repetitively ejecting and driving such points. The invention also provides a novel valve mechanism incorporated into such a driver, which mechanism is fundamental to the achievement of its optimal operation, and the point driver and valve mechanism of the invention are relatively uncomplicated and inexpensive to manufacture, and are highly efficient and convenient to use.

Having thus described the invention, what is claimed is:

1. A machine for driving framer's and glazier's points, and like fasteners, comprising:

(1) a body;

(2) a hammer assembly supported by said body for reciprocal movement, and including a push member having a contact element, movable during reciprocation of said hammer assembly along a path between first and second positions, for driving contact with a fastener;

(3) support means on said body for disposing fasteners to intercept and contact said push member at a location intermediate said first and second positions, for driving the fasteners outwardly of said second position;

(4) pneumatic means on said body for driving said hammer assembly to move said push member contact element between said first and second positions thereof, said pneumatic means comprising a piston cylinder providing a chamber, a drive piston, and a valve mechanism, said drive piston being reciprocally mounted in said cylinder chamber and having a portion extending therefrom into operative engagement with said hammer assembly, said valve mechanism being operatively connected to said cylinder to control the entry and exit of air into and from said chamber thereof for reciprocation of said piston, and comprising:

(a) valve housing means having an inside wall surface defining an axial passageway therein with opposite ends and with an axial portion extending inwardly from one end thereof, said housing means defining an inlet opening to said passageway at a first location spaced therealong from said one end, with means for connection to an air supply, and an outlet opening from said passageway at a second location spaced axially therealong between said first location and the other of said opposite ends thereof, said outlet opening being in air flow communication with said cylinder chamber, said housing means also having internal structure providing two valve seats axially spaced from one another within said passageway, one of said seats being effectively disposed between said inlet and outlet openings, and the other of said seats being effectively disposed between said outlet opening and said other end of said passageway;

(b) a valve core member slidably disposed within said passageway of said housing means for axial movement between first and second positions, said core member having two sealing elements thereon spaced axially to opposite sides of said valve seats, one of said sealing elements sealingly engaging said one seat in said first position of said core member and the other of said sealing elements sealingly engaging said other seat in said second position thereof, said core member being configured to permit the flow of air between said outlet opening and said other end of said passageway in said first position thereof, and being configured to permit the flow of air between said inlet and outlet openings in said second position thereof, said core member also having a head portion disposed within said axial portion of said passageway in sealing, slidable engagement with said inside wall surface of said housing means thereat; said head portion having an outer surface disposed axially outwardly thereon, and facing away from said other end, and adjacent said one end of said passageway, and said core member having a duct with opposite ends, one of said ends of said duct opening in air-flow communication with said inlet opening and the other of said ends thereof opening at said outer surface of said head portion;

(c) an end wall element on said housing means sealingly overlying said one end of said passageway and defining therewithin a head space over said core member head portion, said end wall element having an opening therethrough; and (d) biasing means for constantly urging said core member toward said end wall element; and (5) an actuating member movably mounted on said body between first and second position, and having a closing element thereon adapted to prevent the flow of air through said opening of said housing means end wall element when disposed thereupon over said opening therethrough, said actuating member being so mounted as to dispose said closing element upon said end wall element and over said opening in said first position thereof, and as to displace said closing element from said opening in said second position thereof, thereby permitting the release of air from said head space through said opening.

2. The machine of claim 1 wherein said actuating member is a trigger pivotably mounted on said body, and wherein said machine additionally includes a cylinder housing disposed on said body directly adjacent said valve housing means and providing said piston cylinder.

3. The machine of claim 1 wherein said valve core member comprises a generally cylindrical pilot piece and an attached, elongate spool piece, said pilot piece having an axial bore therethrough, and said spool piece having opposite ends and including a tang component at one end inserted into said pilot piece bore and attaching said spool piece thereto, said tang component and said pilot piece cooperatively defining at least a portion of said duct, and said spool piece having said sealing elements thereon.

4. The machine of claim 3 wherein said spool piece further includes a shaft component at its opposite end, said shaft component having a free outer end portion; an abutment element between said tang component and said shaft component; a spacer element on said shaft component intermediate the ends thereof; and a securing element attached to said free end portion of said shaft component, said sealing elements being mounted upon said shaft component with one of said sealing elements retained between said abutment element and said spacer element, and with the other of said sealing elements retained between said securing element and said spacer element.

5. The machine of claim 1 wherein said head portion of said core member is of enlarged trans-axial cross section, relative the remainder thereof.

6. The machine of claim 5 wherein said axial portion of said passageway is of enlarged trans-axial cross section, relative to the remainder thereof, and wherein said head portion has an axial length that is substantially less than the depth of said axial portion of said passageway.

7. The machine of claim 5 wherein said biasing means is a coil spring seated in said axial portion of said passageway about said core member, said spring having one end bearing upon said head portion thereof and having its other end bearing upon a surface of said housing means defining an inner end of said passageway portion.

8. The machine of claim 1 wherein said housing means comprises a housing member and a valve body, said housing member having an elongate cavity in which said valve body is seated, said valve body having a bore therethrough and having said internal structure thereon, within said bore thereof, providing said valve seats, said valve body also having spaced orifices comprising said inlet and outlet openings of said housing means.

9. The machine of claim 8 wherein said bore of said valve body is shorter than said cavity of said housing member, and wherein said head portion of said core member lies axially outwardly of said valve body and is disposed within said cavity, said cavity and bore cooperatively providing said passageway of said housing means.

10. The machine of claim 1 wherein said body of said machine includes guide means defining a channel, and wherein said hammer assembly includes a member supported by said guide means for reciprocal movement within said channel between a retracted position and an extended position of said assembly, said retracted and extended positions corresponding, respectively, to said first and second positions of said contact element.

11. The machine of claim 10 wherein said guide means has, at the bottom of said body, a support wall on which said machine rests in normal use thereof, said support wall having an opening therethrough; and wherein said hammer assembly member has a detent component downwardly disposed thereon and downwardly biased therefrom, said detent component having an element thereon that is engagable, with structure of said support wall defining said opening, to prevent movement of said assembly from said retracted position to said extended position thereof, said detent component registering with said opening in said retracted assembly position and having a protruding portion thereon that extends through said opening beyond said support wall when said detent component is so engaged, said protruding portion being so constructed that when the outermost surface thereof is substantially flush with the outer surface of said support wall said element of said detent component will be disengaged from said opening-defining structure, so as to release said assembly for movement toward said extended position.

12. A valve mechanism comprising:

(a) valve housing means having an inside wall surface defining an axial passageway therein with opposite ends and with an axial portion extending inwardly from one end thereof, said housing means defining an inlet opening to said passageway at a first location spaced therealong from said one end, with means for connection to an air supply, and an outlet opening from said passageway at a second location spaced axially therealong between said first location and the other of said opposite ends thereof, said housing means also having internal structure providing two valve seats axially spaced from one another within said passageway, one of said seats being effectively disposed between said inlet and outlet openings, and the other of said seats being effectively disposed between said outlet opening and said other end of said passageway;

(b) a valve core member slidably disposed within said passageway of said housing means for axial movement between first and second positions, said core member having two sealing elements thereon spaced axially to opposite sides of said valve seats, one of said sealing elements sealingly engaging said one seat in said first position of said core member and the other of said sealing elements sealingly engaging said other seat in said second position thereof, said core member being configured to permit the flow of air between said outlet opening and said other end of said passageway in said first position thereof, and being configured to permit the flow of air between said inlet and outlet openings in said second position thereof, said core member also having a head portion disposed within said axial portion of said passageway in sealing, slidable engagement with said inside wall surface of said housing means thereat, said head portion having an outer surface disposed axially outwardly thereon, and facing away from said other end, and adjacent said one end of said passageway, and said core member having a duct with opposite ends, one of said ends of said duct opening in air-flow communication with said inlet opening and the other of said ends thereof opening at said outer surface of said head portion;

(c) an end wall element on said housing means sealingly overlying said one end of said passageway and defining therewithin a head space over said core member head portion, said end wall element having an opening therethrough; and (d) mechanical biasing means for constantly urging said core member toward said end wall element.

13. The mechanism of claim 12 wherein said valve core member comprises a generally cylindrical pilot piece and an attached, elongate spool piece, said pilot piece having an axial bore therethrough, and said spool piece having opposite ends and including a tang component at one end inserted into said pilot piece bore and attaching said spool piece thereto, said tang component and said pilot piece cooperatively defining at least a portion of said duct, and said spool piece having said sealing elements thereon.

14. The mechanism of claim 13 wherein said spool piece further includes a shaft component at its opposite end, said shaft component having a free outer end portion; an abutment element between said tang component and said shaft component; a spacer element on said shaft component intermediate the ends thereof; and a securing element attached to said free end portion of said shaft component, said sealing elements being mounted upon said shaft component with one of said sealing elements retained between said abutment element and said spacer element, and with the other of said sealing elements retained between said securing element and said spacer element.

15. The mechanism of claim 12 wherein said head portion of said core member is of enlarged trans-axial cross section, relative to the remainder thereof.

16. The mechanism of claim 15 wherein said axial portion of said passageway is of enlarged trans-axial cross section, relative to the remainder thereof, and wherein said head portion has an axial length that is substantially less than the depth of said axial portion of said passageway.

17. The mechanism of claim 15 wherein said biasing means is a coil spring seated in said axial portion of said passageway about said core member, said spring having one end bearing upon said head portion thereof and having its other end bearing upon a surface of said housing means defining an inner end of said passageway portion.

18. The mechanism of claim 12 wherein said housing means comprises a housing member and a valve body, said housing member having an elongate cavity in which said valve body is seated, said valve body having a bore therethrough and having said internal structure thereon, within said bore thereof, providing said valve seats, said valve body also having spaced orifices comprising said inlet and outlet openings of said housing means.

19. The mechanism of claim 18 wherein said bore of said valve body is shorter than said cavity of said housing member, and wherein said head portion of said core member lies axially outwardly of said valve body and is disposed within said cavity, said cavity and bore cooperatively providing said passageway of said housing means.

* * * * *